US007124882B1

(12) United States Patent
Jadydy

(10) Patent No.: US 7,124,882 B1
(45) Date of Patent: Oct. 24, 2006

(54) PIPE CLEANING KIT

(76) Inventor: Emyr Jadydy, 5316 Ambridge Dr., Calabasas, CA (US) 91301

( * ) Notice: Subject to any disclaimer, the term of this patent is extended or adjusted under 35 U.S.C. 154(b) by 324 days.

(21) Appl. No.: 10/759,861

(22) Filed: Jan. 20, 2004

(51) Int. Cl.
*B65D 69/00* (2006.01)

(52) U.S. Cl. ..... 206/234; 206/373; 15/104.04; 15/104.05; 15/104.095; 15/104.2

(58) Field of Classification Search ..... 206/223, 206/234, 372, 373, 38, 216; 15/104.03–104.05, 15/104.09, 104.095, 105, 106, 160, 104.2; 228/205
See application file for complete search history.

(56) References Cited

U.S. PATENT DOCUMENTS

| | | | | |
|---|---|---|---|---|
| 3,188,674 | A | 6/1965 | Hobbs | |
| 3,266,075 | A | 8/1966 | Conrad | |
| 4,467,489 | A | 8/1984 | Begneaud | |
| D298,086 | S | 10/1988 | Dollar, Jr. | |
| 4,862,549 | A * | 9/1989 | Criswell et al. | 15/104.04 |
| 5,058,327 | A | 10/1991 | Buchanan | |
| 5,168,660 | A | 12/1992 | Smith | |
| 5,493,748 | A * | 2/1996 | Santo | 15/104.04 |
| 5,803,254 | A * | 9/1998 | Vasudeva | 206/373 |
| 6,393,645 | B1 * | 5/2002 | Kadinger | 15/104.04 |
| 6,704,964 | B1 * | 3/2004 | Knowles | 15/104.04 |
| 6,708,363 | B1 * | 3/2004 | Larsen | 15/160 |
| 6,769,151 | B1 * | 8/2004 | Lin | 15/104.04 |

* cited by examiner

*Primary Examiner*—Luan K. Bui

(57) ABSTRACT

A cleaning kit operable by a tool for cleaning pipes and fittings to prepare same for soldering. The cleaning kit includes a plurality of sockets including wire bristles attached thereto and for receiving the outer surface of a pipe therealong. The plurality of pipes are maintain in continuous contact with a pipe surface for cleaning same while a tool rotatably engages the plurality of sockets about the pipe. The cleaning kit also includes a shank for receiving the plurality of sockets therein and for removably connecting to a tool respectively. A wire brush including a lower end portion and a second shank connected thereto is removably attachable to a tool so that the wire brush can rotatably engage an interior of a pipe and thereby clean same.

14 Claims, 4 Drawing Sheets

PIPE CLEANING KIT

BACKGROUND OF THE INVENTION

1. Technical Field

This invention relates to a pipe cleaning kit and, more particularly, to a rotatable tool-operated pipe-cleaning kit.

2. Prior Art

Soldering or brazing of pipe or tubing requires that the mating (or faying) surfaces of the pipe and fittings be thoroughly cleaned to present oxide-free and contaminant free surfaces which can be wetted by the molten solder or brazing alloy. This is required to form sound joints which are free of porosity and voids and which do not leak. Degreasing the joint components, if necessary, and then abrading the faying surfaces normally accomplish this.

Degreasing is accomplished by wiping with a solvent appropriate for the oily contaminant to be removed. Oxides and dry contaminants are manually removed by rubbing with dry steel wool, emery cloth, or wire brushes. They may also be removed by using motor driven brushes or emery cloth. Proper cleaning of joint members prior to soldering or brazing is essential in order to economically form sound joints. Clean joint surfaces can be rapidly soldered or brazed using a minimum of heat, flux, and filler alloy.

These economies of time, energy, and materials more than offset the cost of proper cleaning. Manual cleaning of a large number of tube/fitting joint components can become tedious and time consuming and can, thus, lead to operator inattention and error. Clearly, motor driven abrasion means can eliminate tedium and permit rapid and effective cleaning of large numbers of joint components.

Accordingly, a need remains for a pipe cleaning kit that overcomes the above-noted shortcomings.

BRIEF SUMMARY OF THE INVENTION

In view of the foregoing background, it is therefore an object of the present invention to provide a device for a pipe cleaning kit. These and other objects, features, and advantages of the invention are provided by a cleaning kit operable by a power-operated tool or a manually-operated tool, for cleaning pipes and fittings to prepare same for soldering. The cleaning kit includes a plurality of sockets that preferably have substantially cylindrical bodies and a centrally disposed longitudinal axis passing therethrough. The plurality of sockets further include opposed end portions integral with the body with centrally disposed openings formed therein respectively.

The plurality of sockets further include a plurality of wire bristles attached to one of the opposed openings, preferably extending radially inwardly therefrom and towards the axis. Such bristles receive an outer surface of a pipe therealong and maintain continuous surface contact therewith for cleaning same while a tool rotatably engages the plurality of sockets about a pipe. The plurality of wire bristles are preferably formed from stainless steel, as well-known in the industry.

The present invention further includes a first shank that has a square end portion for selectively receiving the plurality of sockets therein. The first shank further has an oppositely spaced hexagonal end portion for removably connecting to a tool respectively.

The device further includes a wire brush including a lower end portion and a second shank connected thereto. The second shank advantageously has a hexagonal shape and is removably attachable to a tool so that same can be rotatably engaged with an interior of a pipe and thereby clean same. The wire brush preferably has a substantially conical shape and may further have an apex oppositely spaced from the shank. Of course, the wire brush may be formed to have alternate shapes, as well-known to a person of ordinary skill in the art.

The cleaning kit further includes a carrying case including lower and upper sections pivotally engageable with each other and for defining a cavity therebetween for storing the plurality of sockets and the shank and the wire brush therein. The carrying case may further include a handle preferably attached to the upper section and extending outwardly therefrom.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
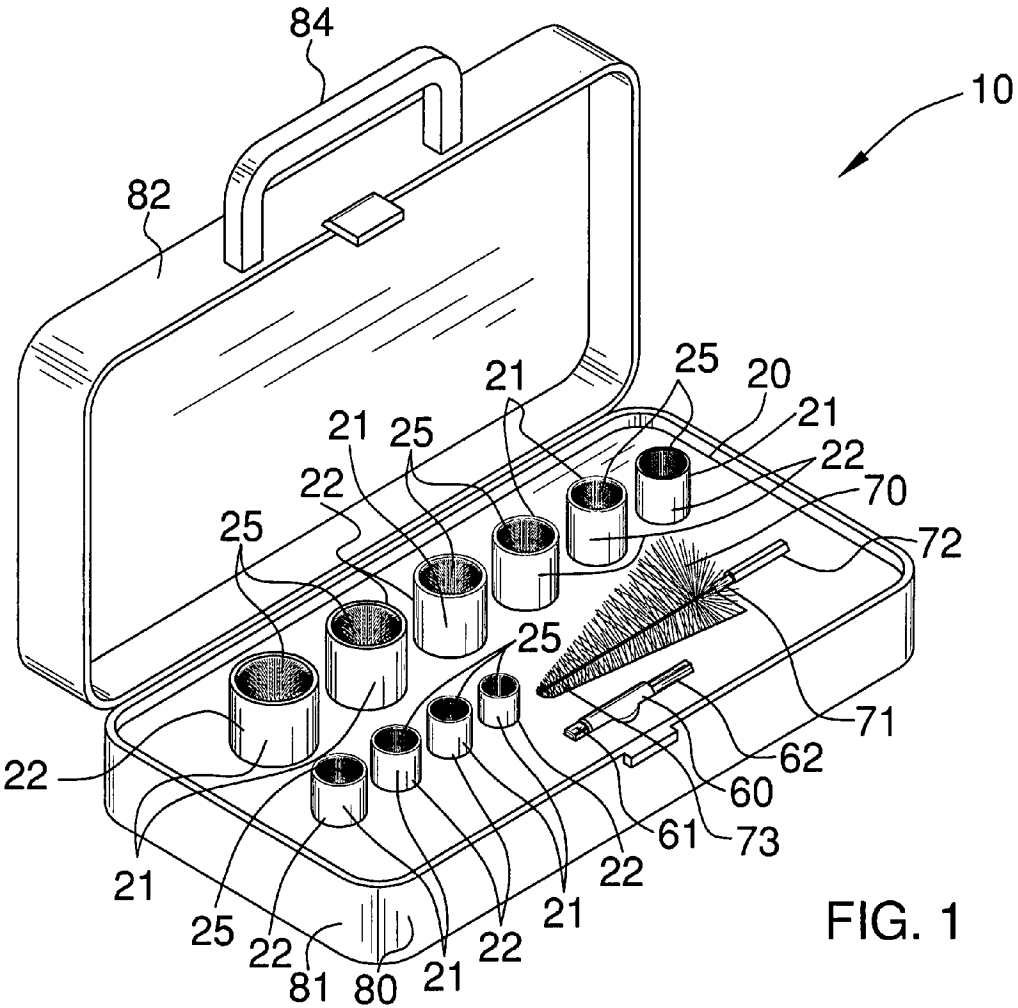
FIG. 1 is a perspective view showing a pipe cleaning kit, in accordance with the present invention.
Figure 2:
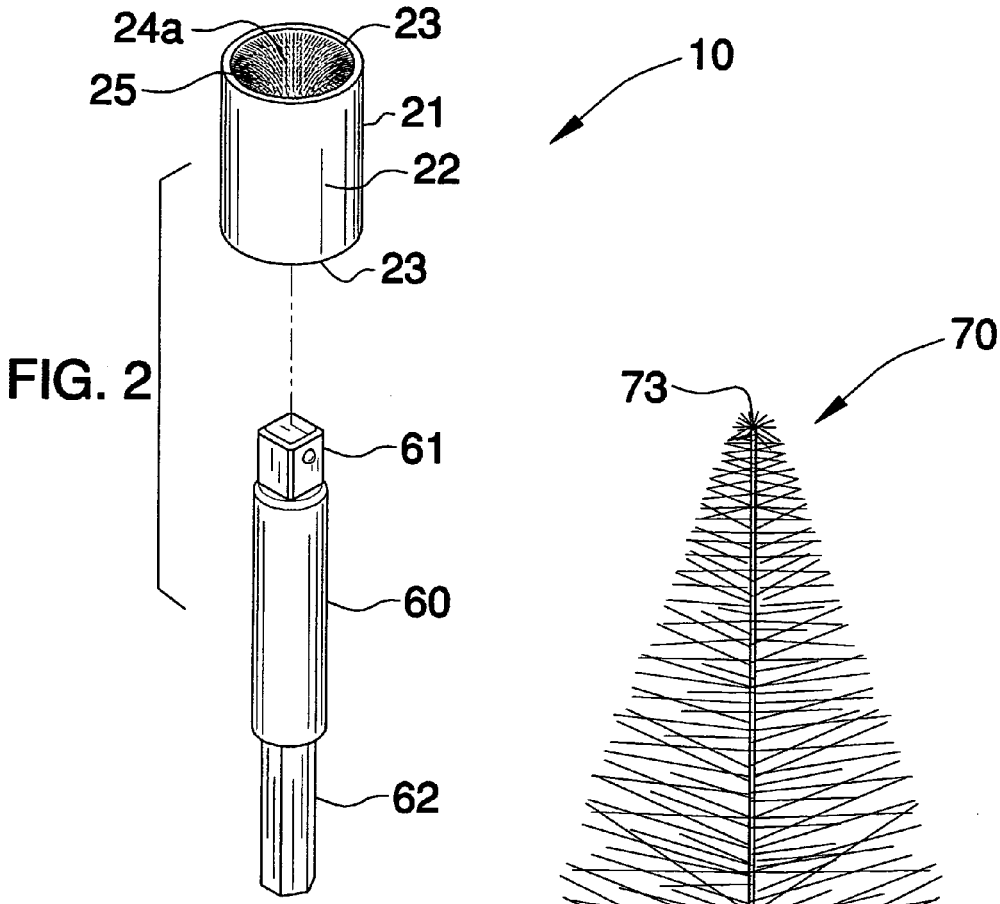
FIG. 2 is an enlarged perspective view of the shank and a socket shown in FIG. 1.
Figure 3:
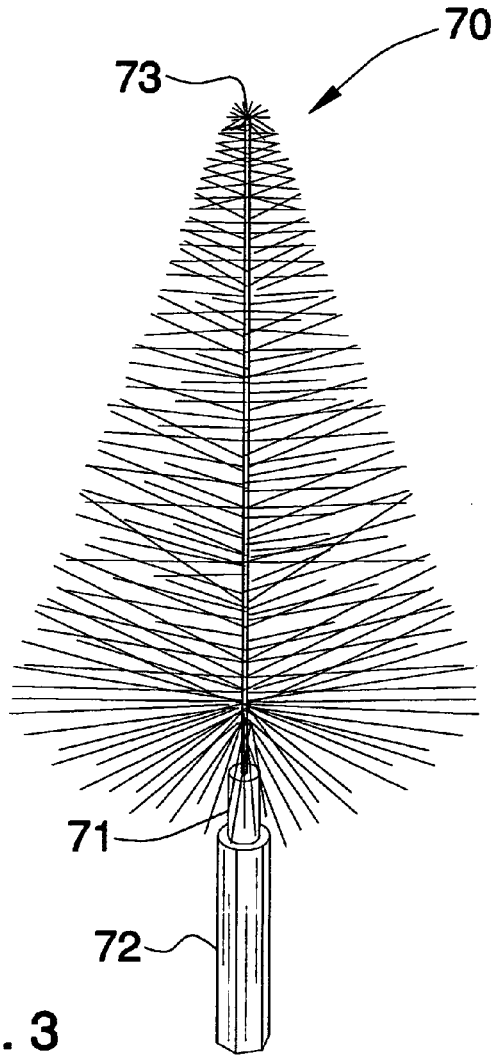
FIG. 3 is an enlarged perspective view of the wire brush shown in FIG. 1.
Figure 4:
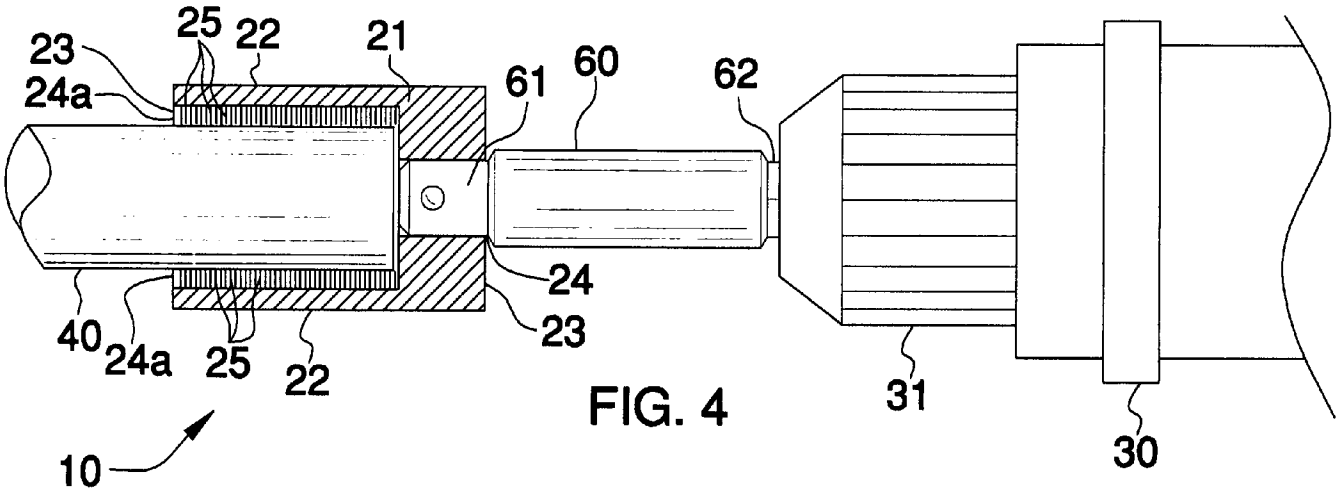
FIG. 4 is an enlarged cross-sectional view showing the present invention in a preferred environment.
Figure 5:
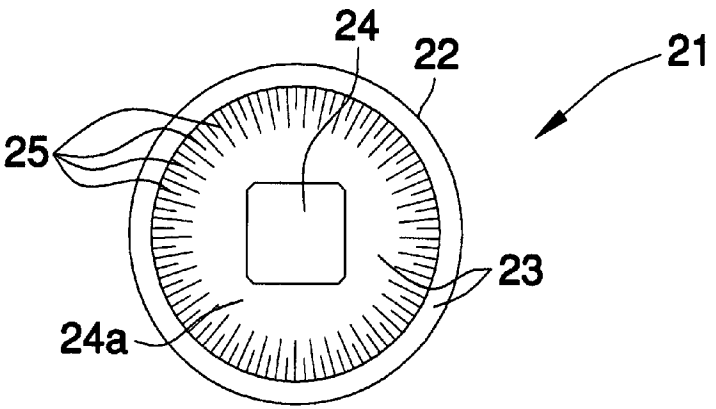
FIG. 5 is an enlarged top plan view of a socket shown in FIG. 1.
Figure 6:
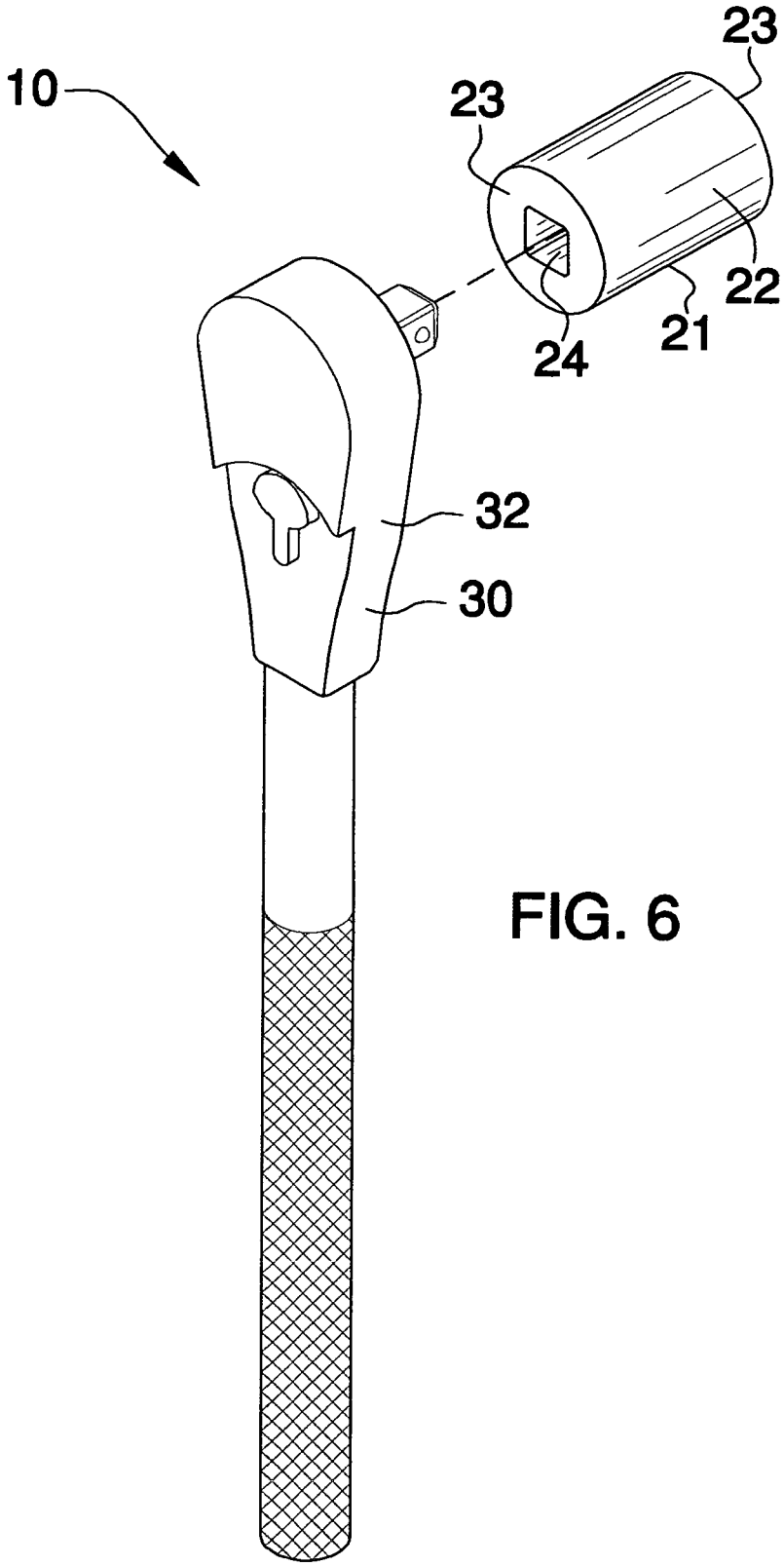
FIG. 6 is a perspective view of a socket shown in FIG. 1 and engaged with a manually operable tool.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements and prime notations refer to alternate elements throughout the figures.

The assembly of this invention is referred to generally in FIGS. 1–6 by the reference numeral 10 and is intended to protect a pipe cleaning kit. It should be understood that the assembly 10 may be used to clean many different types of pipes and surfaces and therefore should not be limited to cleaning only copper pipes and associated fittings.

Referring initially to FIG. 1, the device 10 includes a cleaning kit 20 operable by a tool 30 and for cleaning pipes 40 and fittings 50 to prepare same for soldering. The cleaning kit 20 includes a plurality of sockets 21 including substantially cylindrical bodies 22 and has a centrally disposed longitudinal axis passing therethrough. The plurality of sockets 21 further include opposed end portions 23 integral with the body 22 that has centrally disposed openings 24 formed therein respectively.

The plurality of sockets 21 further include a plurality of wire bristles 25 attached to one of the opposed openings 24*a*, extending radially inwardly therefrom and towards the axis for receiving an outer surface of a pipe 40 therealong and maintaining continuous surface contact therewith for cleaning same while a tool 30 rotatably engages the plurality of sockets 21 about a pipe 30. The plurality of wire bristles 25 are formed from stainless steel. The device 10 can further advantageously be operated by a power-operated tool 31 or a manually-operated tool 32.

The present invention further includes a first shank 60 that has a square end portion 61 for selectively receiving the plurality of sockets 21 therein. The first shank 60 further has an oppositely spaced hexagonal end portion 62 for removably connecting to a tool 30 respectively.

The device further includes a wire brush 70 including a lower end portion 71 and a second shank 72 connected thereto. The second shank 72 advantageously has a hexagonal shape and is removably attachable to a tool 30 so that same can be rotatably engaged with the interior of a pipe 40 and thereby clean same. The wire brush 70 has a substantially conical shape and further has an apex 73 oppositely spaced from the shank 72.

The cleaning kit 20 further includes a carrying case 80 including lower 81 and upper 82 sections pivotally 83 engageable with each other, defining a cavity therebetween for storing the plurality of sockets 21 and the shank 60 and the wire brush 70 therein. The carrying case 80 further includes a handle 84 attached to the upper section 82 and extending outwardly therefrom.

The appealing features of this cleaning kit 20 are its universal attachment, ease of use, time saving qualities, reduced manual labor, affordability and improved job quality. Plumbers and pipe fitters along with do-it-yourselfers may use this cleaning kit 20 to clean various surfaces, especially cleaning copper pipes 40 and fittings 50 to create near perfect soldering bonds.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

The invention claimed is:

1. A cleaning kit operable by a tool and for cleaning pipes and fittings to prepare same for soldering, said cleaning kit comprising:

a plurality of unitary sockets having single bodies, said sockets including substantially cylindrical bodies and having a centrally disposed longitudinal axis passing therethrough, said plurality of sockets further including opposed end portions integral with said body, said opposed end portions having centrally disposed openings formed therein respectively, said plurality of sockets further including a plurality of wire bristles attached to one said opposed openings and extending radially inwardly therefrom and towards the axis for receiving an outer surface of a pipe therealong and maintaining continuous surface contact therewith for cleaning same while a tool rotatably engages said plurality of sockets about a pipe;

a first shank having a square end portion for selectively receiving said plurality of sockets therein, said first shank further having an oppositely spaced hexagonal end portion for removably connecting to a tool respectively; and a wire brush including a lower end portion and a second shank connected thereto, said second shank having a hexagonal shape and being removably attachable to a tool so that same can rotatably engaged with an interior of a pipe and thereby clean same;

a carrying case including lower and upper sections pivotally engageable with each other and for defining a cavity therebetween for storing said plurality of sockets and said shank and said wire brush therein;

said lower end portion of said wire brush being disposed on top of said second shank such that said lower end portion of said wire brush remains spaced from the tool during operating conditions;

wherein each of said sockets are independently attached to said first shank such that only one of said sockets is attached to said shank during operating conditions;

wherein a bottom one of said openings of said sockets has a square shape mated with said first end portion of said first shank;

wherein said second shank is medially seated between said lower end portion of said wire brush and the tool;

wherein a top one of said openings of said sockets has a diameter greater than a width of said bottom opening, said top opening terminating at said bottom opening such that said top and bottom openings are in fluid communication with each other.

2. The cleaning kit of claim 1, wherein said carrying case further comprises:

a handle attached to said upper section and extending outwardly therefrom.

3. The cleaning kit of claim 1, wherein said plurality of wire bristles are formed from stainless steel.

4. The cleaning kit of claim 1, wherein said tool comprises:

one of a power-operated tool and manually-operated tool.

5. The cleaning kit of claim 1, wherein said wire brush has a substantially conical shape and further has an apex oppositely spaced from said shank.

6. A cleaning kit operable by a tool and for cleaning pipes and fittings to prepare same for soldering, said cleaning kit comprising:

a plurality of unitary sockets having single bodies, said sockets including substantially cylindrical bodies and having a centrally disposed longitudinal axis passing therethrough, said plurality of sockets further including opposed end portions integral with said body, said opposed end portions having centrally disposed openings formed therein respectively, said plurality of sockets further including a plurality of wire bristles attached to one said opposed openings and extending radially inwardly therefrom and towards the axis for receiving an outer surface of a pipe therealong and maintaining continuous surface contact therewith for cleaning same while a tool rotatably engages said plurality of sockets about a pipe;

a first shank having a square end portion for selectively receiving said plurality of sockets therein, said first shank further having an oppositely spaced hexagonal end portion for removably connecting to a tool respectively;

a wire brush including a lower end portion and a second shank connected thereto, said second shank having a hexagonal shape and being removably attachable to a tool so that same can rotatably engaged with an interior of a pipe and thereby clean same; and a carrying case including lower and upper sections pivotally engageable with each other and for defining a cavity therebetween for storing said plurality of sockets and said shank and said wire brush therein;

said lower end portion of said wire brush being disposed on top of said second shank such that said lower end portion of said wire brush remains spaced from the tool during operating conditions;

wherein each of said sockets are independently attached to said first shank such that only one of said sockets is attached to said shank during operating conditions;

wherein a bottom one of said openings of said sockets has a square shape mated with said first end portion of said first shank;

wherein said second shank is medially seated between said lower end portion of said wire brush and the tool;

wherein a top one of said openings of said sockets has a diameter greater than a width of said bottom opening, said top opening terminating at said bottom opening such that said top and bottom openings are in fluid communication with each other.

7. The cleaning kit of claim 6, wherein said carrying case further comprises:

a handle attached to said upper section and extending outwardly therefrom.

8. The cleaning kit of claim 6, wherein said plurality of wire bristles are formed from stainless steel.

9. The cleaning kit of claim 6, wherein said tool comprises:

one of a power-operated tool and manually-operated tool.

10. The cleaning kit of claim 6, wherein said wire brush has a substantially conical shape and further has an apex oppositely spaced from said shank.

11. A cleaning kit operable by a tool and for cleaning pipes and fittings to prepare same for soldering, said cleaning kit comprising:

a plurality of unitary sockets having single bodies, said sockets including substantially cylindrical bodies and having a centrally disposed longitudinal axis passing therethrough, said plurality of sockets further including opposed end portions integral with said body, said opposed end portions having centrally disposed openings formed therein respectively, said plurality of sockets further including a plurality of wire bristles attached to one said opposed openings and extending radially inwardly therefrom and towards the axis for receiving an outer surface of a pipe therealong and maintaining continuous surface contact therewith for cleaning same white a tool rotatably engages said plurality of sockets about a pipe;

a first shank having a square end portion for selectively receiving said plurality of sockets therein, said first shank further having an oppositely spaced hexagonal end portion for removably connecting to a tool respectively;

a wire brush including a lower end portion and a second shank connected thereto, said second shank having a hexagonal shape and being removably attachable to a tool so that same can rotatably engaged with an interior of a pipe and thereby clean same; and a carrying case including lower and upper sections pivotally engageable with each other and for defining a cavity therebetween for storing said plurality of sockets and said shank and said wire brush therein, said carrying case further including a handle attached to said upper section and extending outwardly therefrom;

said lower end portion of said wire brush being disposed on top of said second shank such that said lower end portion of said wire brush remains spaced from the tool during operating conditions;

wherein each of said sockets are independently attached to said first shank such that only one of said sockets is attached to said shank during operating conditions;

wherein a bottom one of said openings of said sockets has a square shape mated with said first end portion of said first shank;

wherein said second shank is medially seated between said lower end portion of said wire brush and the tool;

wherein a top one of said openings of said sockets has a diameter greater than a width of said bottom opening, said top opening terminating at said bottom opening such that said top and bottom openings are in fluid communication with each other.

12. The cleaning kit of claim 11, wherein said plurality of wire bristles are formed from stainless steel.

13. The cleaning kit of claim 11, wherein said tool comprises:

one of a power-operated tool and manually-operated tool.

14. The cleaning kit of claim 11, wherein said wire brush has a substantially conical shape and further has an apex oppositely spaced from said shank.

* * * * *